US005106595A

United States Patent [19]

Ellenberg

[11] Patent Number: 5,106,595

[45] Date of Patent: Apr. 21, 1992

[54] DEVICE FOR STERILIZING THE MOUTHS OF CONTAINERS, IN PARTICULAR OF BAG TYPE CONTAINERS FOR FOODSTUFFS

[75] Inventor: Martin Ellenberg, Langhirano, Italy

[73] Assignee: EL.PO S.r.l., Mulazzano Ponte, Italy

[21] Appl. No.: 438,601

[22] Filed: Nov. 17, 1989

[30] Foreign Application Priority Data

Nov. 25, 1988 [IT] Italy ..... 40174 A/88

[51] Int. Cl.[5] ..... A61L 2/00; B65B 55/04

[52] U.S. Cl. ..... 422/302; 422/292; 422/28; 141/82; 141/85; 53/426; 426/407

[58] Field of Search ..... 422/292, 28, 307, 302; 426/399, 401, 407, 410; 53/425, 167, 319, 426; 141/82, 85

[56] References Cited

U.S. PATENT DOCUMENTS

| | | | |
|---|---|---|---|
| 3,164,936 | 1/1965 | Löliger | 53/167 |
| 3,681,892 | 8/1972 | Safranski | 53/180 |
| 3,831,644 | 8/1974 | Berg et al. | 141/82 |
| 4,537,749 | 8/1985 | Hick | 422/302 |
| 4,742,667 | 5/1988 | Müller et al. | 422/302 |
| 4,805,378 | 2/1989 | Anderson | 53/426 |
| 4,830,865 | 5/1989 | McFarlane et al. | 426/399 |
| 4,893,659 | 1/1990 | Löliger | 141/85 |
| 4,942,716 | 7/1990 | Anderson | 53/426 |

FOREIGN PATENT DOCUMENTS 0115963 6/1984 European Pat. Off. .

*Primary Examiner*—Robert J. Warden
*Assistant Examiner*—Theresa A. Trembley
*Attorney, Agent, or Firm*—Darby & Darby

[57] ABSTRACT

The device serves to sterilize the filler neck and stopper associated with non-rigid bags of the type utilized for packaging tomato juice and similar foodstuffs. The neck is inserted into a heated and temperature-regulated cylindrical housing provided internally with an array of nozzles from which sterilizer ($H_2O_2$) is sprayed into the encompassed enclosure; sterilization is achieved as the atomized fluid condenses uniformly on contact with the colder surfaces of the mouth and stopper.

7 Claims, 2 Drawing Sheets

8
4
1
7
I
I
II
II
9
5
3
2

1
III
III
6

1
10
12
11

24
25
26
27
28
29
30
31
20
21
22
23

DEVICE FOR STERILIZING THE MOUTHS OF CONTAINERS, IN PARTICULAR OF BAG TYPE CONTAINERS FOR FOODSTUFFS

BACKGROUND OF THE INVENTION

The invention relates to a device for sterilizing the mouths of containers, in particular the filler necks of bag type containers used for foodstuffs. Such as device is intended specifically, though by no means exclusively, for association with batching equipment of the type by which the bags are filled in sterile conditions with an edible commodity, for example tomato juice or the like.

The single bag is provided generally with a neck, usually of cylindrical shape, the projecting end of which affords a mouth to receive the foodstuff; with the filling operation completed, a stopper is inserted in the mouth to ensure a hermetic seal. Sterile batching is effected by way of a dispensing valve operated internally of a small sterilized enclosure, the bottom of which affords an opening designed to accommodate the neck of the container; in operation, the neck is clasped externally by a suitable device and held in position inside the enclosure throughout the filling cycle.

To ensure absolutely sterile conditions throughout the filling operation, the entire area of the bag encircling the mouth, hence the filler neck, must be sterilized prior to its entering the sterilized dispensing enclosure.

The object of the invention is to provide a simple and efficient expedient for meeting the requirement in question through the adoption of a device which will sterilize the external area of the mouth and the related stopper prior to implementation of the filling operation.

SUMMARY OF THE INVENTION

The stated object is realized with a device of the type disclosed, which comprises a heated housing capable of accommodating the filler neck and stopper of a bag and provided internally with an array of nozzles from which sterilizer fluid is sprayed inwards at the filler, the cloud of atomized fluid condensing uniformly on contact with the colder surfaces of the neck and stopper.

Advantages afforded by the present invention are simplicity in construction and compact dimensions, by virtue of which the device is rendered suitable for application to and operation internally of the sterile dispensing enclosures of food batching equipment as mentioned above.

BRIEF DESCRIPTION OF THE DRAWINGS

The invention will now be described in detail, by way of example, with the said of the accompanying schematic drawings, in which.

DESCRIPTION OF THE PREFERRED EMBODIMENTS

Figure 1:
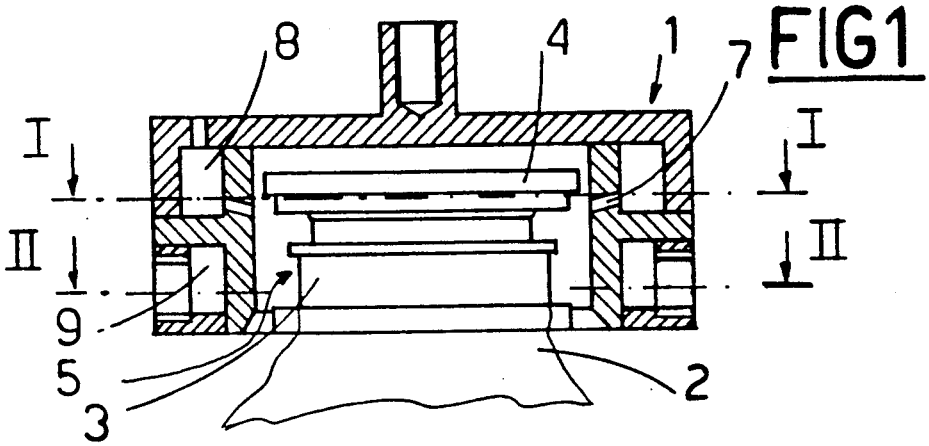
FIG. 1 is a container mouth sterilizer in accordance with the invention in a section.
Figure 2:
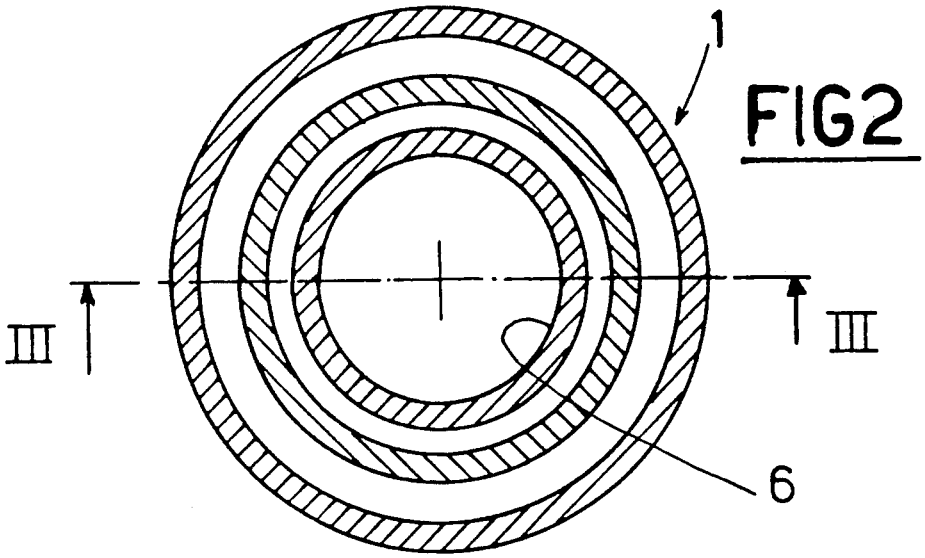
FIG. 2 is the section through I—I of FIG. 1.
Figure 3:
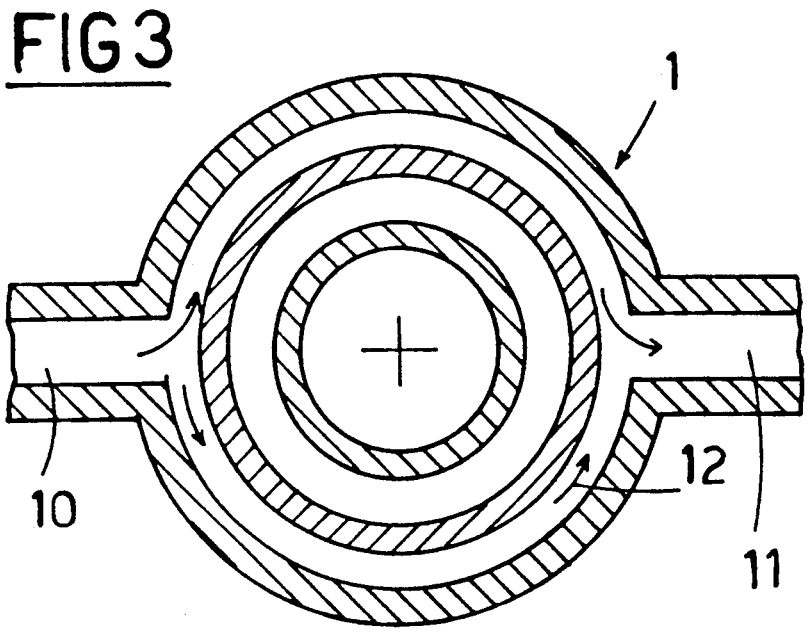
FIG. 3 is the section through II—II of FIG. 1.

With reference to FIGS. 1, 2, and 3 of the drawings, 1 denotes a housing, in its entirety, located for example adjacent or inside the sterile enclosure of a dispensing head from which a given foodstuff is batched into bag type containers 2.

The housing 1 is proportioned so as to accommodate the mouth of a bag type container 2, which consists in a neck 3, affording an opening generally plugged by a stopper 4. The entire filler, comprising neck 3, stopper 4 and mouth 6, is denoted 5 in FIG. 1

The housing 1 is of cylindrical shape, and provided with a plurality of atomizer nozzles 7 arranged in a ring around the upper section the cylinder; the nozzles 7 connect with a single annular duct 8 and are positioned with axes radially disposed, to all indents and purposes.

In operation, a fluid sterilizer (hydrogen peroxide or other) is directed into the annular duct 8 and forced to pass through the nozzles 7, atomizing internally of the housing as a result.

More exactly, the atomizer nozzles 7 are angled, preferably at some 10° from the horizontal, in such a way as the direct the fluid sterilizer onto the external surfaces of the filler 5.

The walls of the housing 1 are heated to facilitater atomization of the sterilizer, and held at a prescribed temperature. To this end, the housing incorporates at least one annular cavity 9 in which water vapor is caused to circulate as a means of supplying and bringing about the necessary exchange of heat. Heat generation media other than water vapor may be circulated, or electrical resistance may be used to heat the housing walls to a prescribed temperature.

FIG. 3 is a section in which 10 and 11 denote the heating vapor inlet and outlet, respectively, whilst the arrows 12 denote the direction in which the vapor is circulated through eh cavity 9.

Once the filler 5 is inserted into the housing 1, all external surfaces of the neck 3 and stopper 4 are exposed to the cloud of atomized sterilizing fluid sprayed from e nozzles 7.

Figure 4:
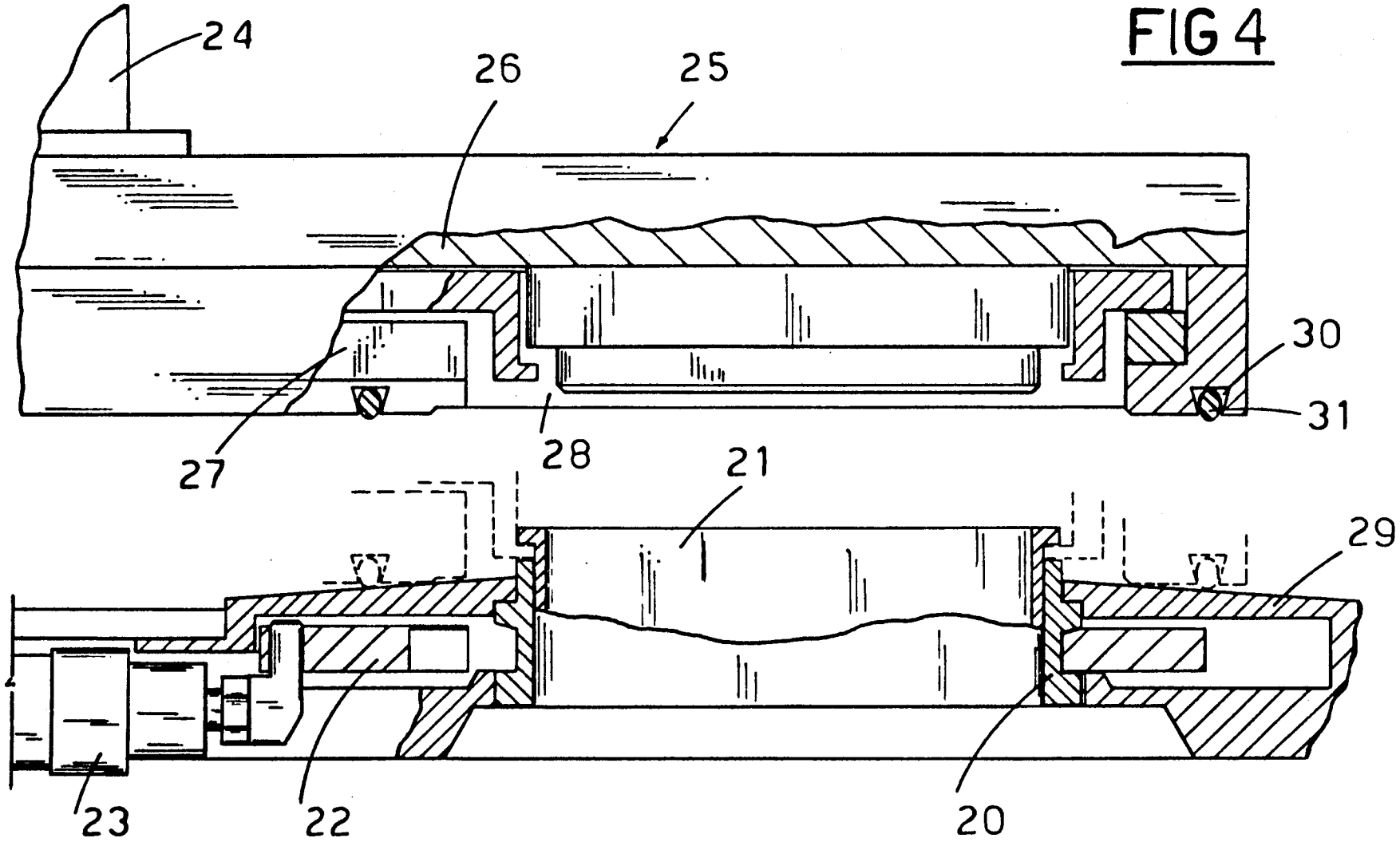
FIG. 4 illustrates an alternative embodiment of a container mouth sterilizer in accordance with the invention, viewed in longitudinal section.
Figure 4:
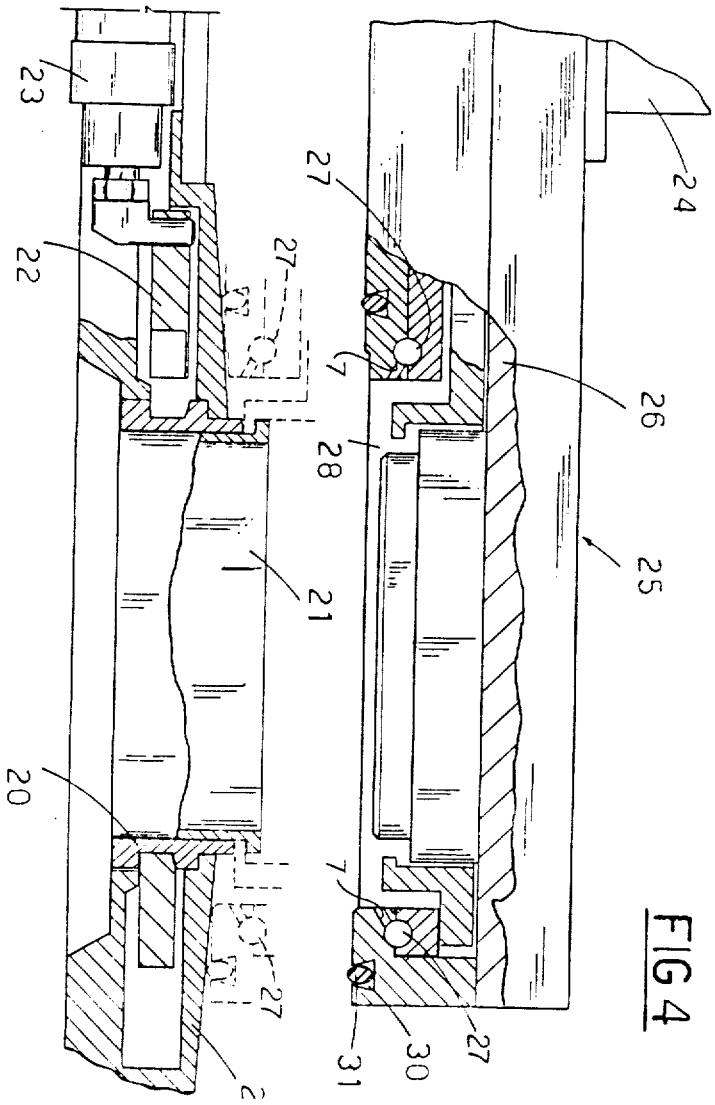

In FIG. 4, which illustrates a further embodiment of the device, 20 and 21 respectively denote the neck and the stopper of a bag, held between the gripping jaws of a mechanism 22 operated by a pneumatic cylinder 23.

25 denotes the sterilizer device proper, which is carried in coaxial alignment with and above the mouth of the bag, by a rotatable shaft 24.

The device 25 comprises a plate 26, affording an internal channel 27 through which fluid sterilizer is directed through nozzles 7 (as in FIG. 1) into an annular chamber denoted 28; the chamber totally encompasses the neck and stopper of the bag, and is created by causing the plate 26 to descend and enter into fluid-tight contact with a further plate 29, which also carries the jaws of the gripping mechanism 22.

In order to ensure a perfectly tight fit during the sterilization cycle, the bottom face of the upper plate 26 is embodied with an annular groove 30 in which to seat a seal 31 capable of registering elastically with the topmost surface of the lower plate 29, as illustrated by the phantom lines in FIG. 4.

What is claimed:

1. A sterilizer for the mouth and filler neck of a bag container, said filler neck having a side wall and an opening, at the end of said filler neck requiring a stopper, said bag container being used for packaging foodstuffs, comprising:

a housing including a cavity having a first surface for surrounding a filler neck side wall and a second surface for opposing an opening at the end of said filler neck requiring a stopper;

a plurality of atomizer nozzles distributed around said first surface and directed to discharge a flow against the exterior of said filler neck side wall when a container is positioned within said cavity during use of said sterilizer;

duct means connected to said atomizer nozzles for containing a sterilizing fluid;

heating means including cavity means for heating walls of said housing to a prescribed temperature whereby said sterilizing fluid may receive thermal energy before exiting said nozzles, heat being exchanged to said walls from said cavity means, and walls being physically separated from the cavity means in said housing, with heat exchange paths between said cavity means and said walls.

2. A sterilizer as in claim 1, wherein the atomizer nozzles are arranged in a ring formation around an upper part of the housing.

3. A sterilizer as in claim 2, wherein said nozzles are oriented radially around the longitudinal axis of said container filler neck and substantially at a right angle to aid axis.

4. A sterilizer as in claim 2, wherein said duct means include a single annular duct encircling the housing, through which, in used hydrogen peroxide or other fluid sterilizer may be directed to the nozzles for atomization.

5. A sterilizer as in claim 1, wherein said cavity means include at least one annular cavity encircling a lower part of the housing, in use, water vapor is circulated in said annular cavity in order to supply and to bring about the necessary exchange of thermal energy.

6. A sterilizer as in claim 5, wherein said heating means include one of electrical resistance and heat-generating media other than water vapor.

7. A sterilizer as in claim 1, wherein the housing includes two plates disposed one above the other, one said plate having a first portion of said cavity for the accommodation of the filler neck of the bag, and the other said plate having a second portion of said cavity and said duct means by way of which fluid sterilizer may be directed into the cavity, said plates being movable relative to each other, in use, and said housing cavity being completed by bringing said plates together.

* * * * *

UNITED STATES PATENT AND TRADEMARK OFFICE

CERTIFICATE OF CORRECTION

PATENT NO. : 5,106,595

DATED : April 21, 1992

INVENTOR(S) : Martin ELLENBERG

It is certified that error appears in the above-indentified patent and that said Letters Patent is hereby corrected as shown below:

IN THE DRAWINGS

Delete Drawing Sheet 2 and substitute therefor the Drawing Sheet consisting of FIG 4 as shown on the attached page.

Signed and Sealed this

First Day of March, 1994

Bruce Lehman

*Attest:*

BRUCE LEHMAN

*Attesting Officer*

*Commissioner of Patents and Trademarks*